US012433381B2

(12) United States Patent
Krulik et al.

(10) Patent No.: US 12,433,381 B2
(45) Date of Patent: Oct. 7, 2025

(54) PUSH BUTTON EXPANSION SYSTEM FOR LUGGAGE

(71) Applicant: United States Luggage, Hauppauge, NY (US)

(72) Inventors: Richard Krulik, Northport, NY (US); Adam Courter, Long Beach, NY (US); Hayley Lawson, Long Beach, NY (US); Jon Davies, Riverhead, NY (US)

(73) Assignee: United States Luggage, Hauppauge, NY (US)

( * ) Notice: Subject to any disclaimer, the term of this patent is extended or adjusted under 35 U.S.C. 154(b) by 161 days.

(21) Appl. No.: 18/221,626

(22) Filed: Jul. 13, 2023

(65) Prior Publication Data

US 2024/0016272 A1 Jan. 18, 2024

Related U.S. Application Data

(60) Provisional application No. 63/468,901, filed on May 25, 2023, provisional application No. 63/389,602, filed on Jul. 15, 2022.

(51) Int. Cl.
*A45C 7/00* (2006.01)
*A45C 5/03* (2006.01)

(52) U.S. Cl.
CPC ..... *A45C 7/0022* (2013.01); *A45C 5/03* (2013.01); *A45C 7/0063* (2013.01)

(58) Field of Classification Search
CPC ..... A45C 7/022; A45C 5/03; A45C 5/0063
See application file for complete search history.

(56) References Cited

U.S. PATENT DOCUMENTS 340,567 A * 4/1886 French ..... A45C 7/0031 190/105
1,705,526 A * 3/1929 Kennedy ..... A45C 7/0031 292/281

(Continued)

FOREIGN PATENT DOCUMENTS

CA 1134599 A 11/1982
EP 1788903 B1 11/2012

(Continued)

OTHER PUBLICATIONS

Office Action dated Dec. 2, 2024 received in a related U.S. Patent Application, namely U.S. Appl. No. 18/221,616, 17 pages.

(Continued)

*Primary Examiner* — Tri M Mai
(74) *Attorney, Agent, or Firm* — Scully, Scott, Murphy & Presser, P.C.

(57) ABSTRACT

A compression-expansion device for an article of luggage and luggage comprising same is disclosed. In one embodiment, the device comprises a base comprising axially-disposed, spaced-apart, parallel passageways; a latch pivotably disposed on the base between the passageways and having a tongue projection; an expansion body comprising conduit members slidably mated to the passageways, bias members located within the passageways and conduit members which urge the expansion body and base away from each other; an opening in the expansion body configured to receive the tongue in a first compressed position; and a button engaged with the opening and moveable to contact the tongue and displace it from the first position to a second position whereby the expansion body and the base assume an expanded configuration as urged by the bias members.

24 Claims, 12 Drawing Sheets

(56) References Cited

U.S. PATENT DOCUMENTS

| | | | | |
|---|---|---|---|---|
| 2,079,476 | A | 5/1937 | Lise | |
| 4,310,952 | A | 1/1982 | Robben et al. | |
| 4,844,215 | A | 7/1989 | Ambasz | |
| 5,106,132 | A | 4/1992 | Bako et al. | |
| 5,216,905 | A | 6/1993 | Sersch et al. | |
| 5,671,831 | A | 9/1997 | Chiu | |
| 6,220,411 | B1 | 4/2001 | Scicluna et al. | |
| 6,305,513 | B1 | 10/2001 | Lu | |
| 6,390,259 | B1 * | 5/2002 | Lu | A45C 7/0022 190/103 |
| 6,408,997 | B1 * | 6/2002 | Chen | A45C 5/14 190/103 |
| 7,086,191 | B2 | 8/2006 | Orr | |
| 7,086,510 | B2 | 8/2006 | Smith et al. | |
| 7,093,700 | B2 | 8/2006 | Krulik et al. | |
| 7,281,616 | B2 | 10/2007 | Peterson et al. | |
| 7,328,779 | B2 | 2/2008 | King et al. | |
| 7,405,927 | B2 | 7/2008 | Lev | |
| 8,152,118 | B2 | 4/2012 | Melic | |
| 8,479,900 | B2 | 7/2013 | Scicluna | |
| 8,479,932 | B2 | 7/2013 | Carney | |
| 8,499,776 | B2 | 8/2013 | Ban | |
| 10,571,070 | B2 | 2/2020 | Gray et al. | |
| 2002/0040834 | A1 * | 4/2002 | Chen | A45C 7/0031 190/103 |
| 2005/0067244 | A1 | 3/2005 | Smith et al. | |
| 2006/0070837 | A1 | 4/2006 | King et al. | |
| 2006/0265846 | A1 | 11/2006 | Webber et al. | |
| 2007/0158157 | A1 | 7/2007 | Krulik et al. | |
| 2013/0140119 | A1 | 6/2013 | Hogan et al. | |
| 2016/0262515 | A1 | 9/2016 | Kung | |
| 2017/0332755 | A1 | 11/2017 | Chiang | |
| 2019/0335867 | A1 | 11/2019 | Hogan et al. | |
| 2022/0167718 | A1 | 6/2022 | Krulik et al. | |

FOREIGN PATENT DOCUMENTS

| | | | |
|---|---|---|---|
| EP | 1833320 | B1 | 4/2014 |
| KR | 20140102202 | A | 8/2014 |
| TW | M335178 | U | 7/2008 |

OTHER PUBLICATIONS

International Search Report and Written Opinion received in a corresponding application, namely International application No. PCT/US 23/27700, dated Oct. 5, 2023, 11 pages.

International Search Report and Written Opinion received in a related application, namely International application No. PCT/US 23/27701, dated Oct. 12, 2023, 11 pages.

Luggage, 2021, 1 page.

* cited by examiner

PUSH BUTTON EXPANSION SYSTEM FOR LUGGAGE

This application claims priority to U.S. Provisional Patent Application Ser. No. 63/389,602 filed Jul. 15, 2022, the entire contents of which are incorporated herein by reference, and claims priority to U.S. Provisional Patent Application Ser. No. 63/468,901 filed May 2023, the entire contents of which are incorporated herein by reference.

FIELD

The disclosure relates to a compression-expansion device useful in luggage to increase or decrease the luggage internal capacity as needed. The disclosure also relates to luggage comprising such a compression-expansion device.

BACKGROUND

Expandable luggage as known in the art includes various designs to permit the compression and expansion of the luggage to accommodate internal volume needs. Such devices often require the person packing the luggage to use two hands or require multiple steps to manipulate the device, or have complicated designs that effect the luggage itself. There is thus a need for a compression-expansion device of simpler construction, including a desirable design that permits operation of the device by the push of a button, which can be easily accomplished with one hand, including practices where the button is located on the outside of the article of luggage.

SUMMARY

In one practice, the disclosure is directed to a compression-expansion device for an article of luggage which comprises (a) a base comprising a front face, a rear face, a top edge, and a bottom edge, and a pair of spaced apart, parallel passageways axially disposed from the top edge of the base to the bottom edge the base; (b) a latch comprising an upper end, a lower end, and an inside face, the latch interposed between the pair of spaced apart passageways with the inside face of the latch disposed opposite the front face of the base, the upper end of the latch extending above the top edge of the base, the upper end comprising a tongue projecting outwardly from the inside face of the latch, and the lower end of the latch pivotably attached to the base; (c) a biasing member connecting the latch to the base and urging the latch toward the front face of the base; (d) an expansion body comprising an inner face, and outer face, an upper edge, a bottom edge, and a pair of spaced apart, parallel conduit members extending from the bottom edge of the expansion body, each of the parallel conduit members individually mated in a slidable manner with a respective passageway of the base; a pair of bias members, each individually disposed within a respective passageway of the base and its respective conduit member, and each bias member individually urging the expansion body away from the base to an expanded configuration; an opening in the expansion body extending between the inner face and outer face and configured to receive the tongue of the latch member from the direction of the inner outer face, the opening comprising a ridge on which the tongue rests in a first position wherein the expansion body and the base are in a compressed configuration, and (e) a button engaged with the opening of the expansion body from the direction of the outer face, the button moveable within the opening to contact the tongue so as to sufficiently displace the tongue off the ridge to a second position whereby the expansion body and the base assume the expanded configuration urged by the pair of bias members.

In another practice, the disclosure is directed to a compression-expansion device for an article of luggage which comprises (a) a base comprising a front face, a rear face, a top edge, and a bottom edge; a pair of spaced apart, parallel passageways axially disposed from the top edge of the base to the bottom edge the base, and an opening in the base extending between the front face and the rear face; (b an expansion body comprising an inner face, and outer face, an upper edge, a bottom edge, and a pair of spaced apart, parallel conduit members extending from the bottom edge of the expansion body, each of the parallel conduit members individually mated in a slidable manner with a respective passageway of the base; a pair of bias members, each individually disposed within a respective passageway and its respective conduit member, and each individually urging the expansion body away from the base to an expanded configuration; and a cross member extending between and perpendicular to the pair of spaced apart, parallel conduit members, the cross member comprising an upper ridge; (c) a latch comprising an upper end, a lower end, and an inside face, the latch interposed between the pair of spaced apart passageways with the inside face of the latch disposed opposite the front face of the base, the upper end of the latch extending above the top edge of the base, the upper end comprising a tongue projecting outwardly from the inside face of the latch, the tongue configured to rest on the upper ridge of the cross member in a first position wherein the expansion body and the base are in a compressed configuration, the latch pivotably attached to the base; (d) a biasing member connecting the latch to the base and urging the latch toward the front face of the base; and (e) a button engaged with the opening of the base from the direction of the rear face, the button moveable to contact the latch so as to sufficiently pivot the latch and displace the tongue off the upper ridge of the cross member to a second position whereby the expansion body and the base assume the expanded configuration urged by the pair of bias members.

In another practice, the disclosure is directed to an article of luggage comprising a main luggage body having a bottom surface and a cavity formed to receive articles for packing; an expansion portion having a perimeter defining a cavity; a foldable gusset joining the luggage main body to the expansion portion; and a compression-expansion device disposed internally at respective opposite inner walls of the article of luggage, the compression-expansion device comprising: (i) a base affixed to one of the luggage main body or the expansion portion, the base comprising: a front face, a rear face, a top edge, and a bottom edge; a pair of spaced apart, parallel passageways axially disposed from the top edge of the base to the bottom edge the base; a latch comprising an upper end, a lower end, and an inside face, the latch interposed between the pair of spaced apart passageways with the inside face of the latch disposed opposite the front face of the base, the upper end of the latch extending above the top edge of the base, the upper end comprising a tongue projecting outwardly from the inside face of the latch, and the lower end of the latch pivotably attached to the base; a biasing member connecting the latch to the base and urging the latch toward the front face of the base; (ii) an expansion body affixed to the other of the main luggage body or the expansion portion, the expansion body comprising: an inner face, and outer face, an upper edge, a bottom edge, and a pair of spaced apart, parallel conduit members extending from the bottom edge of the expansion body, each of the parallel conduit members individually mated in a slidable manner with a respective passageway of the base; a pair of bias members, each individually disposed within a respective passageway and its respective conduit member, and each individually urging the expansion body away from the base to an expanded configuration; an opening in the expansion body extending between the inner face and outer face and configured to receive the tongue of the latch member from the direction of the inner face, the opening comprising a ridge on which the tongue rests in a first position wherein the expansion body and the base are in a compressed configuration, and a button engaged with the opening of the expansion body from the direction of the outer face, the button moveable to contact the tongue so as to sufficiently displace the tongue off the ridge to a second position whereby the expansion body and the base assume the expanded configuration urged by the pair of bias members.

DETAILED DESCRIPTION

Figure 1C:
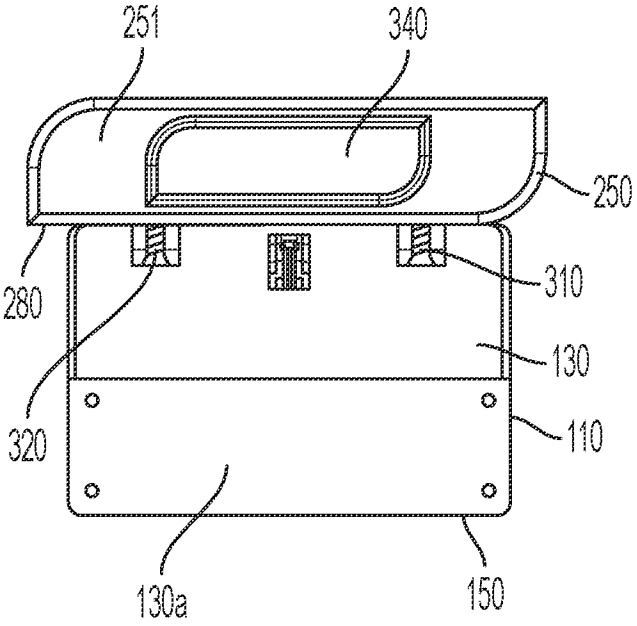
FIG. 1C is a plan view of the button side of the same embodiment in the compressed position.
Figure 1B:
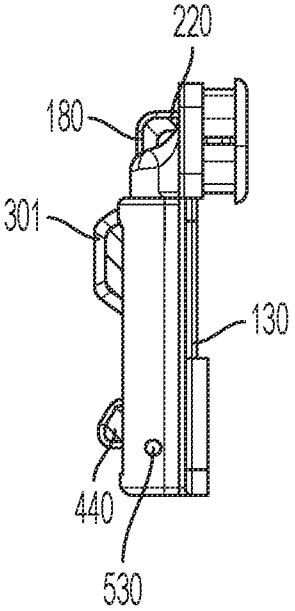
FIG. 1B is a side view of the same embodiment in the compressed position.
Figure 1A:
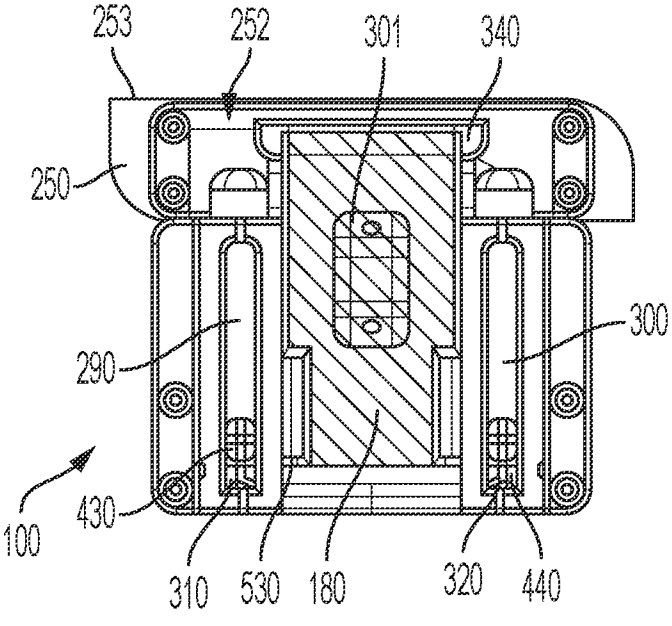
FIG. 1A is a plan view of the latch side of an embodiment of the compression-expansion device of the disclosure, the device being in a compressed position.
Figure 2C:
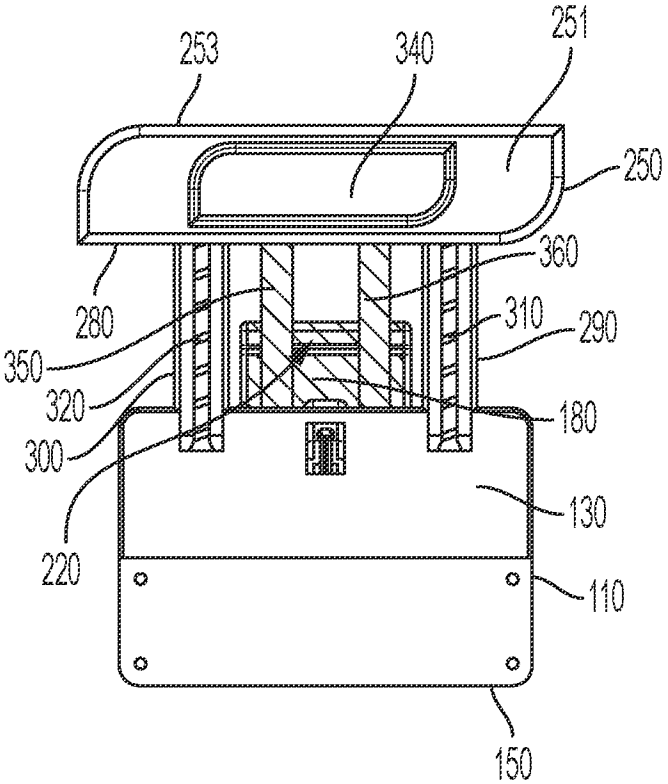
FIG. 2C is a plan view of the button side of the same embodiment in the expanded position.
Figure 2B:
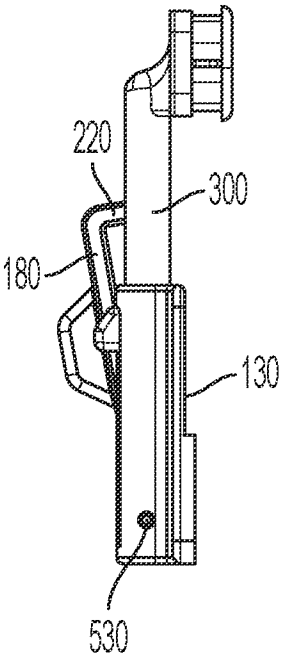
FIG. 2B is a side view of the same embodiment in the expanded position.
Figure 2A:
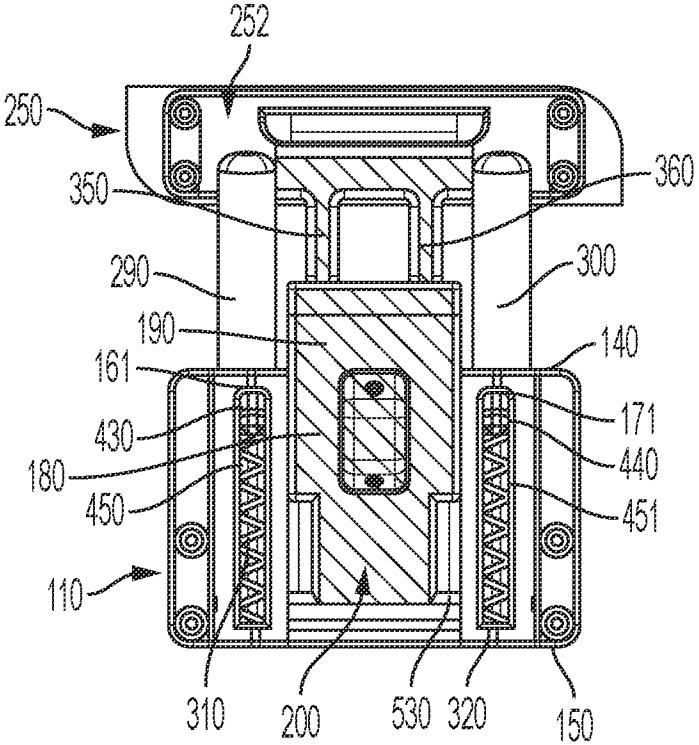
FIG. 2A is a plan view of the latch side of an embodiment of FIG. 1 in an expanded position.

The ensuing detailed description is made with reference to the figures. This is for convenience only and is not limiting to the scope of the disclosure.

Referring to FIGS. 1A, 1B, 1C, 2A, 2B, 2C, 3A, 3B, 3C, 4, and 5, thereat is an embodiment of a compression-expansion device 100 of the disclosure comprising a base 110 comprising a front face 120, a rear face 130, a top edge 140, and a bottom edge 150. As depicted the base may be of generally rectangular shape although other shapes are contemplated. In one practice, rear face 130 may be a straight wall (not shown) or may have a recessed portion shown as 130 in the figures, which rear wall 130 comprises 130*a* as delineated by ledge 131; recessing a portion of the rear wall is useful to permit folding of the expansion gusset material when the device is on the luggage article and is in the compressed position. As sued herein, reference to rear face 130 includes practices where 130 is a straight wall and subsumes practices where 130 is recessed from 130*a*. In the practice shown, the base 110 comprises a pair of spaced apart, parallel passageways 160 (first passageway), 170 (second passageway) axially disposed from the top edge 140 of the base to the bottom edge 150 the base. The passageways 160, 170 may each individually extend the entire axial length of base 110 from the top edge 140 to the bottom edge 150 or only partly so extend. In one non-limiting practice, passageways 160, 170 may each individually comprise a generally tubular channel as depicted which can extend outwardly from the front face 120 of base 110 although other geometries are contemplated. In one practice, the generally tubular channels (or other geometry) that comprise passageways 160, 170 can be integrally formed with the base, e.g. as tubular depressions imprinted onto base 110 which base can be formed from a unitary element such as plastic or metal. In another practice, the generally tubular channels (or other geometry) that comprise passageways 160, 170 can be made of separate pieces that are attached to the front face 120 of base 110.

In the embodiment depicted, a latch 180 (shown in various instances by cross hatching) comprising an upper end 190, a lower end 200, and an inside face 210. As illustrated, the latch is generally rectangular in shape but other suitable shapes can be employed. The latch 180 is interposed between the pair of spaced apart passageways 160, 170 with the inside face 210 of the latch disposed opposite the front face 120 of the base. In the practice shown, the upper end 190 of the latch extends above the top edge 140 of the base, and the upper end 190 comprises a tongue 220 projecting outwardly from the inside face 210 of the latch. As shown, tongue 220 projects outwardly from the very top of upper end 190 and extends across the width of latch 180, this is non-limiting and other tongue configurations are contemplated, e.g. wherein the tongue projects outwardly from below the very top of the upper end and/or extends across only a portion of latch 180.

In the practice depicted, the lower end 200 of the latch 180 is pivotably attached to the base, e.g. is attached to the base to have a pivot axis that is perpendicular to the passageways 160, 170. In the non-limiting practice depicted, latch 180 is pivotably attached to base 180 by pin 370 which is disposed in pin passageway 371 that extends width of latch 180 and which has its ends secured into holes 372 of base 110, which in the embodiment shown are coextensive with the pivot axis. Other methods of pivotably attaching the latch 180 to base 110 as known in the art are contemplated. In the embodiment shown, the latch 180 is connected to the base by a biasing member 240 which can be, e.g., a coil spring as depicted, or other suitable biasing member as known in the art. In the practice shown the biasing member 240 is a coil spring having loops 400 and 410 at either end; base 110 comprises a connection opening 421 within which a boss 420 extends and over which one of loop 410 is placed, the other loop 400 being secured to latch 180 via pin 380 which in the practice shown extends through protrusion 301 of latch 180, the protrusion 301 being sized to accommodate the spring biasing member 240 so that latch 180 remains substantially flush relative to the front face 120 of base 110.

In the embodiment depicted, the device 100 comprises an expansion body 250 that comprising an inner face 260, and outer face 251, an upper edge 252, a bottom edge 280, and a pair of spaced apart, parallel conduit members 290, 300 extending from the bottom edge 280 of the expansion body 250. In the practice shown, each of the spaced apart parallel conduit members 290 (first conduit member) and 300 (second conduit member) are individually mated in a slidable manner with a respective passageway 160 (for conduit member 290) or 170 (for conduit member 300) of the base 110. In the non-limiting practice shown, conduit members 290 and 300 are slidably disposed within passageways 160 and 170 respectively. Other slidable configurations are contemplated. In one non-limiting practice as depicted, conduit members 290, 300 may each individually comprise a generally cylindrical shape, although other geometries for the conduit members are contemplated. In the embodiment illustrated, the pair of spaced apart, parallel passageways 160, 170 each comprise a generally tubular channel extending outwardly from the front face 120 of the base, and each generally cylindrical conduit member 290, 300 is slidably disposed within its respective tubular channel.

As depicted, the device 100 comprises a pair of bias members 310, 320, which are each individually disposed within a respective passageway 160, 170 and its respective conduit member 290, 300. Each bias member 310, 320 is configured to individually urge the expansion body away 250 away from the base 110 to an expanded configuration as shown e.g. in FIGS. 2A, 2B, 2C, and 3C. In one practice, each of bias members 310, 320 comprises a coil spring, although other suitable bias members as known in the art are contemplated. Bias members 310, 320 can be freely disposed within passageways 160, 170 and conduit members 290, 300 without being secured at any of their ends.

In the practice shown, the passageways 160 170 are each depicted as generally tubular channels wherein each channel comprises a slot 450 (in passageway 160) and slot 451 (in passageway 170), each slot 450, 451 being disposed axially in the direction from the top edge 140 to the bottom edge 150 of base 110. The slots may be axially disposed along most or just part of the length from the top edge 140 to the bottom edge 150. As shown, each slot 450, 451 has a first closed end, 161 for slot 450 and 171 for slot 451, proximate the top edge 140 of base 110. Projections 430 and 440 are located proximate the respective distal ends of conduit members 290 and 300. Projections 430 and 440 extend outwardly from conduit members 290, 300 and are configured to extend into slots 450 and 451 respectively and contact the first closed ends 161 and 171 of slots 450 and 451 to stop the movement of the expansion body 250 away from the base 110, e.g. to keep the expansion body 250 from separating from base 110, or to stop the expansion movement at a certain predetermined point.

Figure 3C:
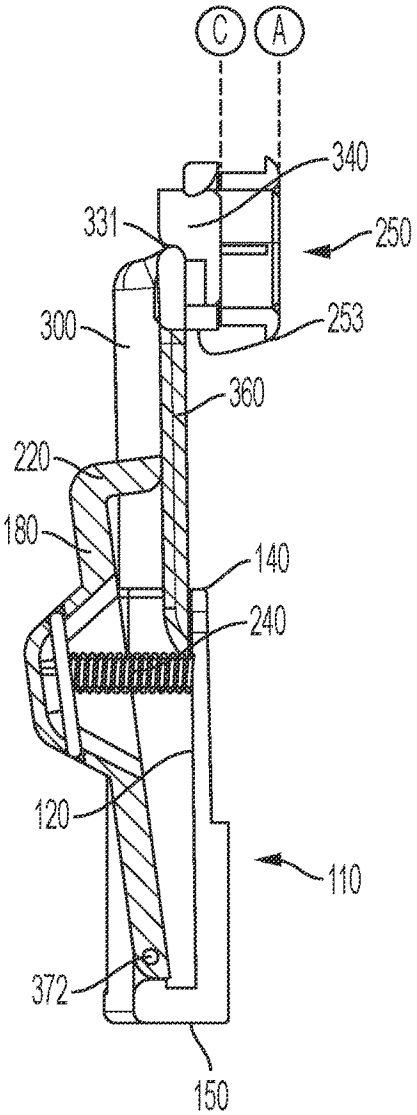
FIG. 3C is a side view as shown in FIG. 2B illustrating certain internal components.
Figure 3B:
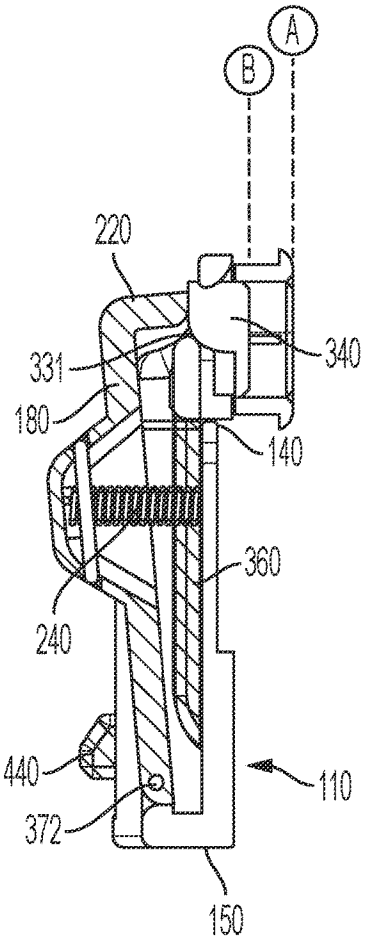
FIG. 3B is a side view as shown in the embodiment of FIG. 1B with the button partly depressed and illustrating certain internal components, the device still in the compressed position.

In the practice shown, the device 100 comprises an opening 340 in the expansion body 250, the opening extending between the inner face 252 and outer face 251 of the expansion body, and configured to receive the tongue 220 of the latch 180 from the direction of the inner face 252 of the expansion body, the opening 330 comprising a ridge 331 on which the tongue 220 rests in a first position wherein the expansion body and the base are in a compressed configuration, as shown in FIGS. 1A, 1B, 1C and 3A. In the compressed configuration, bias members 310 and 320 such as coil springs are fully or partly compressed. Button 340 is engaged with the opening 330 of the expansion body 250 from the direction of the outer face 251, the button 340 moveable to contact the tongue so as to sufficiently displace the tongue off the ridge to a second position whereby the expansion body and the base assume the expanded configuration urged by the pair of bias members. As representatively illustrated in FIG. 3A, the device is in the compressed position (the first position) and tongue 220 rests on ridge 331 and button 340 is at point A (not moved). In FIG. 3B, button 340 commences movement from point A to point B, e.g. as would happen when a user would start to push button 340 inward, whereby button 340 contacts tongue 220 and starts to displace tongue 220 off of ridge 331 causing latch 181 to start to pivot away from base 110 around pivot axis point 372. In FIG. 3C, button 340 has moved to point C which is sufficient to move tongue off of ridge 331 whereby the expansion body 250 and base 110 assume the expanded configuration as urged by the pair of bias members 310, 320 (the second position).

As depicted, expansion body 250 can comprised one or more one latch stopping members 350, 360 which extend from the bottom edge 280 of the expansion body 250 and are interposed between the pair of spaced apart, parallel conduit members 290, 300. As shown in FIG. 3C, latch stopping member 360 (latch stopping member located behind 360 and thus not seen in FIG. 3C) is configured to provide contact with the tongue 220 of the latch 180 in the second position so as to prevent the tongue 220 from extending over the top edge 140 of the base 110 when the expansion body and the base are in the expanded configuration. The one or more latch stopping members 350, 360 can be configured to move over and extend over the front face 120 of base section 110 to permit the expansion body 250 to close together and assume the compressed configuration. In one practice, the distal ends of the one or more latch stopping members 350, 360 terminate coextensive with distal ends of the conduit members 290 300 when in the first compressed position. In one practice as shown, one or more latch stopping members can comprise a plurality of slats, two slats being shown by 350, 360 in FIGS. 2A, 2C and FIGS. 4 and 5. In one practice one latch stopping member in the shape of a wall can be used.

Figure 3A:
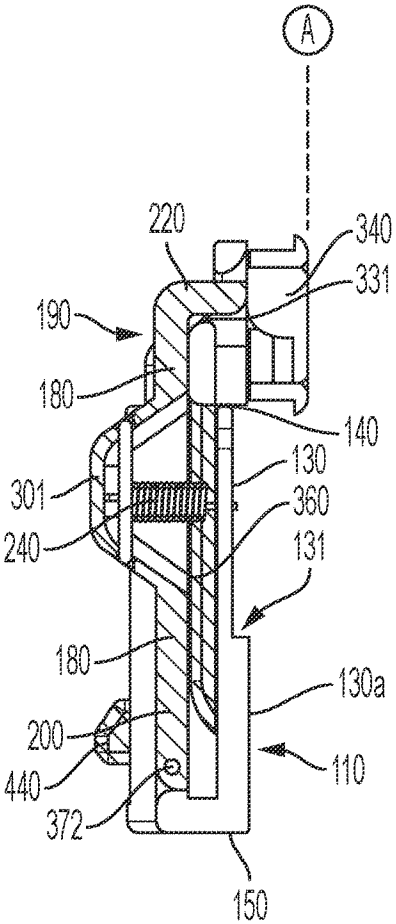
FIG. 3A is a side view as shown in the embodiment of FIG. 1B illustrating certain internal components.
Figure 4:
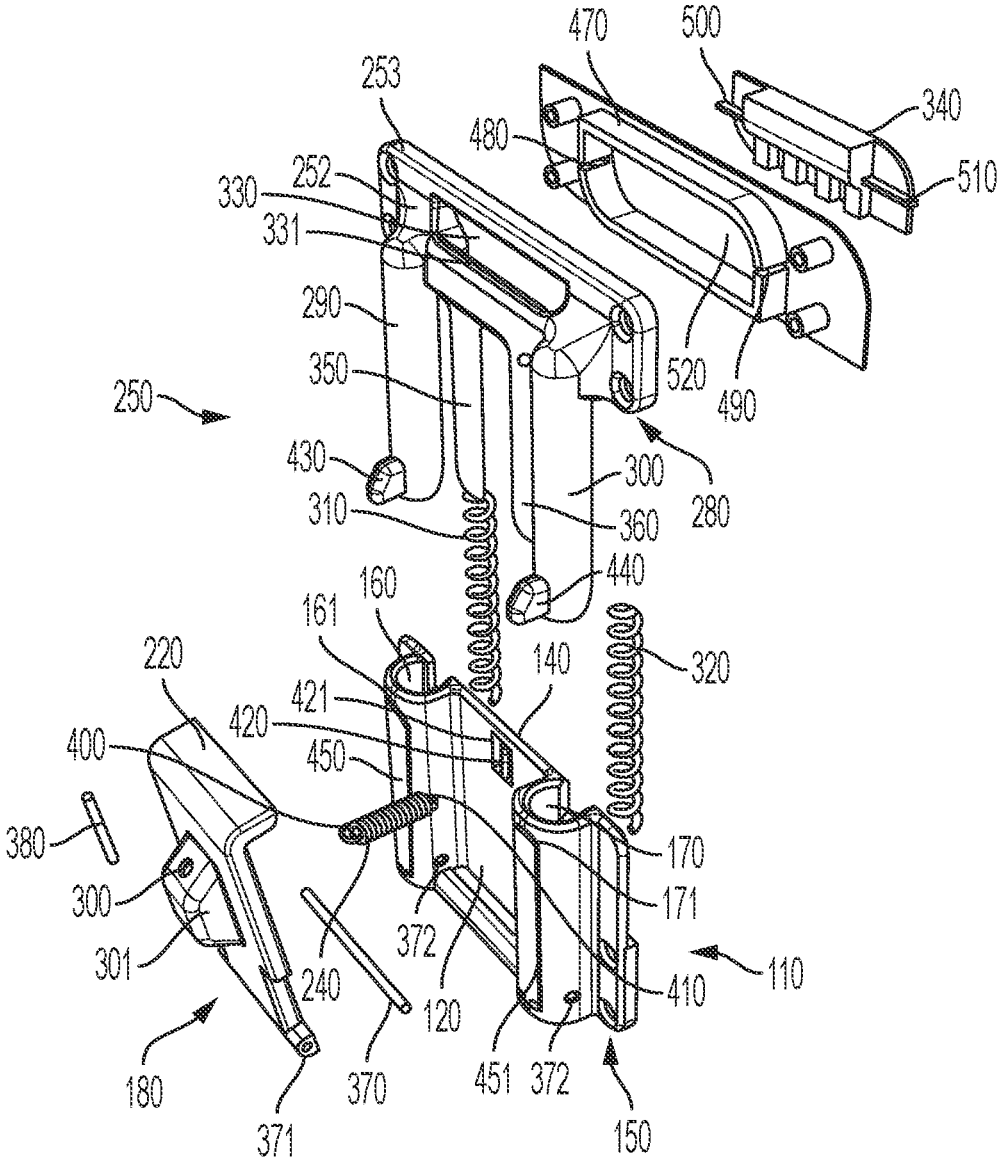
FIG. 4 is an exploded view of the device of FIG. 1 from the perspective of the latch side.
Figure 5:
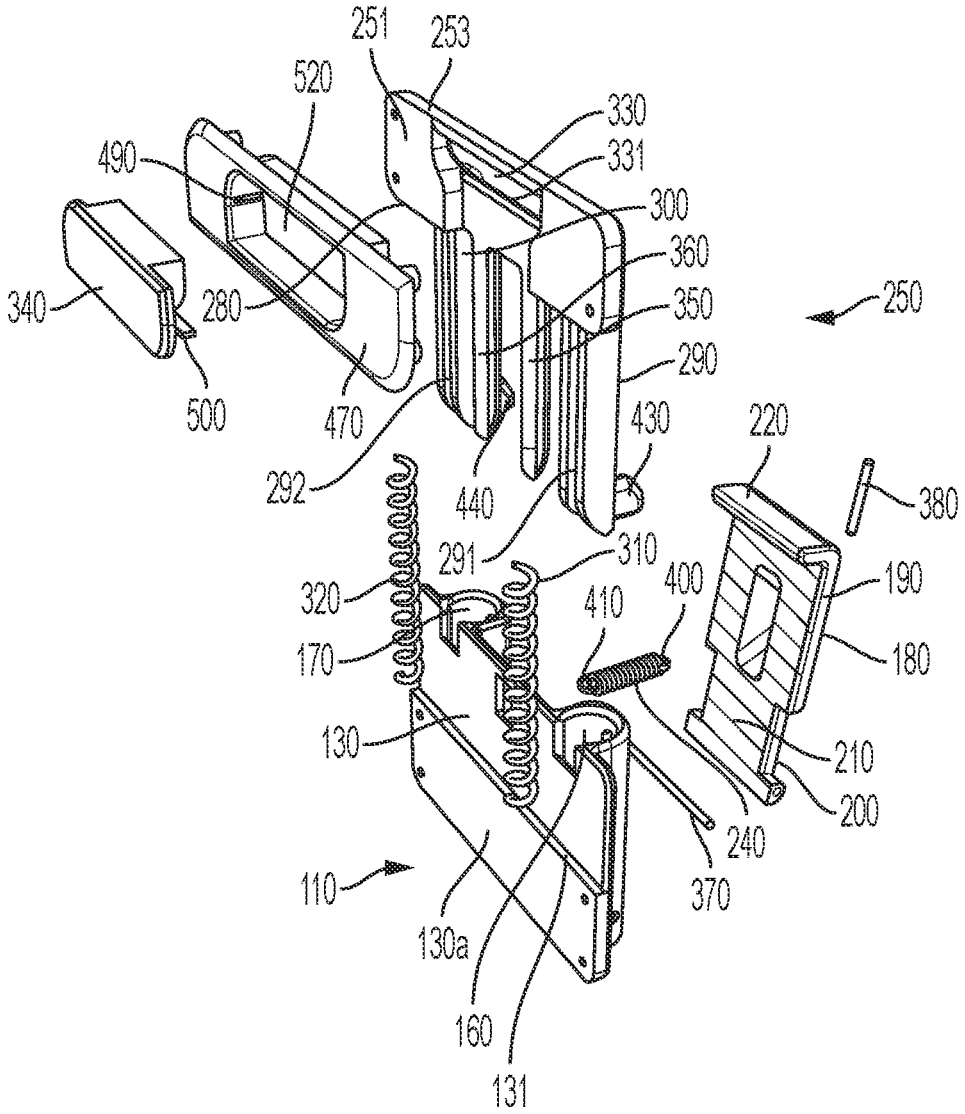
FIG. 5 is an exploded view of the device of FIG. 1 from the perspective of the button side.
Figure 6B:
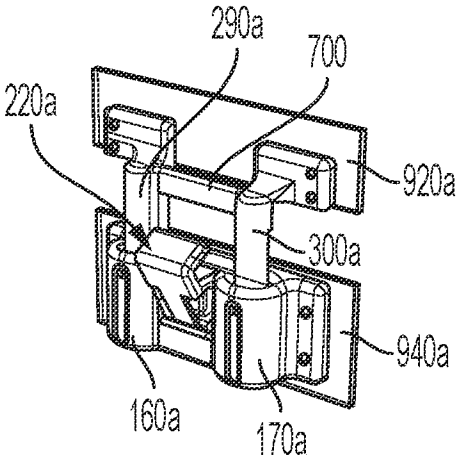
FIGS. 6A and 6B are perspective views of another embodiment of a compression-expansion device of the disclosure on a segment of an article of luggage, the device being in the expanded position.
Figure 6A:
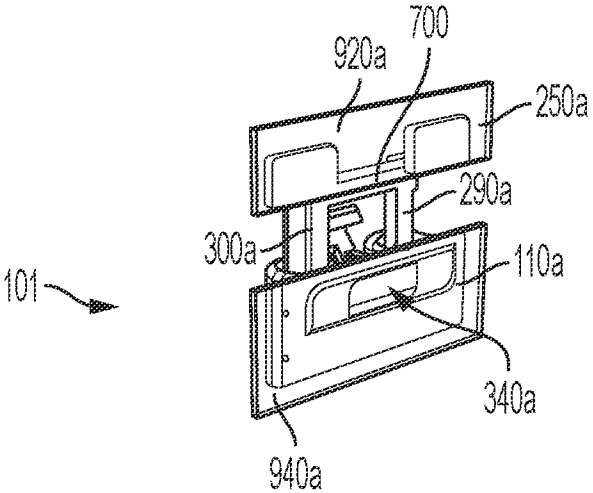
Figure 6E:
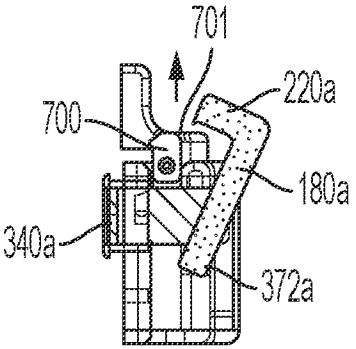
FIGS. 6C, 6D, and 6E are side views of the device of FIGS. 6A and 6B shown from compressed position (FIG. 6C) to an intermediate position as the button is pushed (FIG. 6D) and the position wherein expansion as in FIGS. 6A and 6B occur.
Figure 6D:
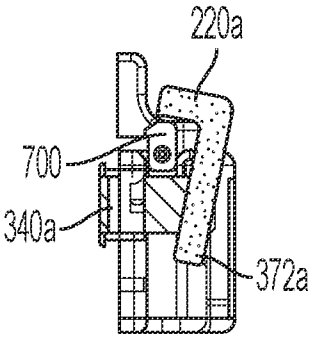
Figure 6C:
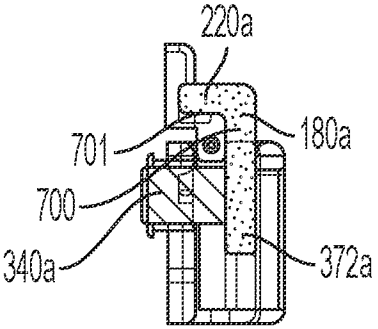

In one embodiment, the device can comprise a button housing 470 disposed against the outside face 251 of the expansion body 250. The button housing 470 can comprise an aperture 520 therethrough, the aperture 520 aligned with and comparable in size with the opening 330 in the expansion body and configured to secure the button in a moveable manner, e.g. button 340 can comprise laterally extending wings 500, 510 that slidably and respectively fit into button slots 490 and 480 in button housing 470, thereby permitting the button to move within openings 520 and 330 to contact tongue 220. In one optional practice as shown in FIG. 3A, button 340 is already in contact with or very close to being in contact with tongue 220 as it rests on ridge 331 in the first position.

The expansion body and base of the compression-expansion device as well as their component parts may comprise any suitable material of construction or combinations of such materials, including without limitation materials that are rigid or semi-rigid. Representative materials of construction comprise plastic, including without limitation plastics exemplified by polyoxymethylene copolymer (POM-C) high rigidity grade, or metal.

At FIGS. 6A, 6B, 6C, 6D, and 6E is another embodiment of a compression-expansion device 101 of the disclosure. This embodiment utilizes a button engaged with an opening in the base portion of the device, not the expansion body as in FIGS. 1 to 5. In referring to the practice in FIGS. 6A to 6E, the configurations, elements, and definitions for FIGS. 1 to 5 apply unless otherwise indicated hereinbelow. Generally, in the practice shown in FIG. 6, the tongue 220*a* of the latch body 180*a* rests on an upper ridge 701 of a cross member 700 that extends between and is perpendicular to the pair of spaced apart, parallel conduit members 290*a* and 300*a* in a first position wherein the expansion body and the base are in a compressed configuration (see FIG. 6C). In this other embodiment, the base 110*a* has an opening therethrough extending between the front face and the rear face, and a button 340*a* (shown) is engaged with that opening in the base and is (obscured by button 340*a*) moveable so as to contact the latch body 180*a* so as to sufficiently pivot the latch around pivot axis 372*a* and displace the tongue 220*a* off the upper ridge 701 of the cross member 700 to a second position whereby the expansion body and the base assume the expanded configuration urged by the pair of bias members (see FIGS. 6A and 6B). More particularly in this practice, the device comprises a base comprising a front face, a rear face, a top edge, and a bottom edge, a pair of spaced apart, parallel passageways axially disposed from the top edge of the base to the bottom edge the base, all as described in FIGS. 1 to 5, and an opening in the base (obscured by button 340*a*) extending between the front face and the rear face.

The device 101 of this other embodiment comprises an expansion body 250*a* comprising an inner face, and outer face, an upper edge, a bottom edge, and a pair of spaced apart, parallel conduit members extending from the bottom edge of the expansion body, each of the parallel conduit members individually mated in a slidable manner with a respective passageway of the base, and a pair of bias members, each individually disposed within a respective passageway and its respective conduit member, and each individually urging the expansion body away from the base to an expanded configuration, all as described in FIGS. 1 to 5. This expansion body 250*a* also of this embodiment of device 101 also comprises a cross member 700 extending between and perpendicular to the pair of spaced apart, parallel conduit members 290*a* and 300*a*, the cross member 700 comprising an upper ridge 701.

In the embodiment shown in FIG. 6, a latch body 180*a* comprising an upper end, a lower end, and an inside face, is interposed between the pair of spaced apart passageways with the inside face of the latch disposed opposite the front face of the base, the upper end of the latch extending above the top edge of the base, the upper end comprising a tongue projecting outwardly from the inside face of the latch, all as described in FIGS. 1 to 5. In the practice shown in FIG. 6, the tongue 220*a* is configured to rest on the upper ridge 701 of the cross member 700 in a first position wherein the expansion body 250*a* and the base 110*a* are in a compressed configuration, the latch pivotably attached to the base, e.g. about pivot axis 372*a*. A biasing member (not shown) connects the latch body 180*a* to the base 110*a* as described in FIGS. 1 to 5, and urges the latch toward the front face of the base.

In the embodiment of FIG. 6, a button 340*a* is engaged with the opening of the base from the direction of the rear face of the base, the button moveable 340*a* configured to contact the latch body 180*a* so as to sufficiently pivot the latch body about axis 372*a* thereby displacing the tongue 200*a* off the upper ridge 701 of the cross member 700 to a second position whereby the expansion body and the base assume the expanded configuration urged by the pair of bias members, as described in FIGS. 1 to 5.

Referring to FIGS. 7A, 7B, 7C, and 7D thereat is depicted embodiments of an article of luggage contemplated by the disclosure embodying a compression-locking device of the disclosure, e.g. as shown in FIGS. 1-6 and FIG. 8-9. In a non-limiting practice, article of luggage 1400 comprises a main luggage body 1440 having a bottom surface 1441 forming a cavity to receive articles for packing. The article of luggage further comprises an expansion portion 1420 having a perimeter defining a cavity. Foldable gusset 1430 joins main luggage body 1440 to expansion portion 1420. Foldable gusset 1430 allows the expansion portion 1420 to move away from luggage main body 1400 in order to expand the volume formed by the cavity of the luggage main body 1440 and the cavity of the expansion portion 1420. Gusset 1430 can be foldable or compressible and can comprise cloth or other suitable material. Cover 1410 is attached to the expansion portion 1420 and is sealable and openable by e.g. zippers and the like. Article of luggage 1400 can be soft-sided or hard-sided or combinations of both and can comprise materials of construction including cloth, metal and plastic. Article of luggage 1400 can comprise wheels as known in the art, e.g. spinner wheels 1490 or rolling wheels (not shown) or feet (not shown) or any combination of the foregoing and can comprise one or more handles (not shown) including a telescoping handle attached to main luggage body 1440 of the expansion portion 1420. In different embodiments, the at least one compression expansion device 100 as described herein can be disposed at an inner internal wall of the article of luggage or on an outer external wall of the luggage. Multiple such devices can be installed, e.g. two devices, each at opposing inner walls or opposing outer walls. In one practice, the button switch which activates expansion is accessible from an outer wall, e.g. the button is accessible to the user without opening the luggage, e.g. the user can depress the button without having to open the luggage inasmuch as the button is a located on or accessible from an outer, external wall surface of the luggage while the remaining components are within the luggage.

Figure 7A:
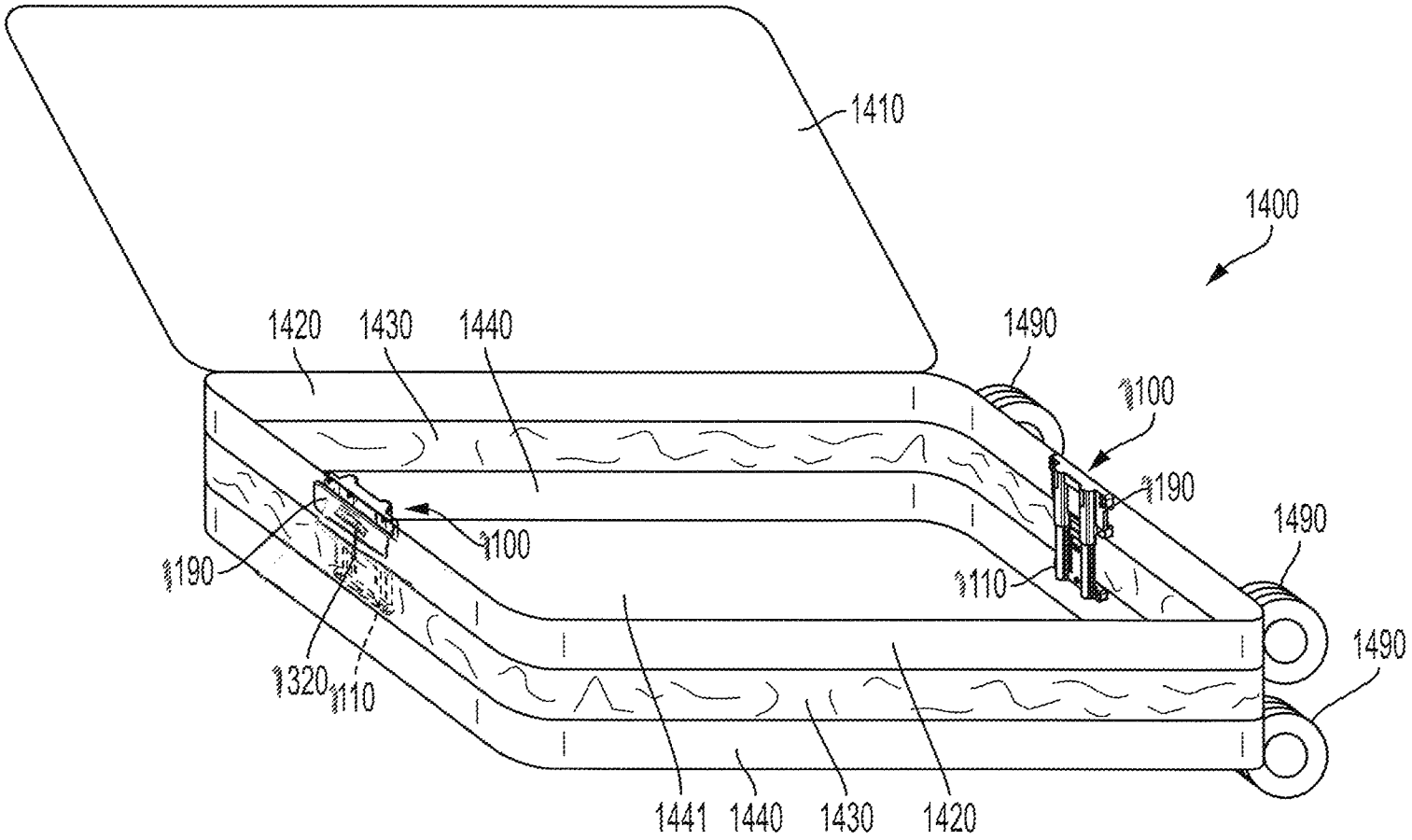
FIGS. 7A, 7B, 7C, 7D are perspective views of the internal area of an embodiment of an article of luggage of the disclosure employing a compression expansion locking device of the disclosure, wherein two devices are placed internally, on opposite inner walls of the luggage and the glide switch is accessible from the outside of the luggage (FIGS. 7A, 7B); and wherein two devices are placed externally on opposite outside walls (FIGS. 7C, 7D).

As shown in the practice of FIGS. 7A to 7D, two compression-expansion devices 1100 are disposed internally at respective opposite inner walls of the article of luggage 1400; in the practice shown base section 1110 is affixed to the main luggage body 1440 and expansion body 1190 is affixed to the expansion portion 1420 of luggage 1400; these affixations can be the reversed for both devices 1100 or for only one of the two devices 1100. In other practices, one or more than two compression-expansion devices and such devices of different embodiments as described herein can be used. As shown in FIG. 7A, the compression expansion device 1100 can comprise, for example, as described herein, a base section 1110 and expansion body 1190, each affixed to one of the luggage main body or the expansion body. As described herein the base section 1110 and expansion body 1190 are disposed in sliding relation to each other and engaged with at least one bias member, e.g. two coil springs which urge the base section 1110 and expansion body 1190 away from each other in an expanded configuration.

In a first embodiment, as described hereinabove and incorporated herein, the base section comprises a flexible portion, the flexible portion comprising a protuberance facing the expansion body, the expansion body comprising a holding surface complimentary to the protuberance and on which the protuberance rests in a first position wherein the base section and the expansion body are in a compressed configuration; and a button 1320 disposed opposite from the protuberance, the button 1320 configured to be moveable when depressed to contact the release protrusion so as to sufficiently displace the protuberance from the holding surface to a second position whereby the base section and the expansion body assume the expanded configuration. Button 1320 is accessible from the outer wall of either the main luggage body or the expansion portion so that a user does not have to open the luggage in order to expand the luggage. Conversely, the user can push either the main luggage body or the expansion portion while in the expanded configuration toward the other while the luggage remains closed and the luggage will assume the compressed configuration as the protuberance will come to click to rest on the holding surface.

Figure 7B:
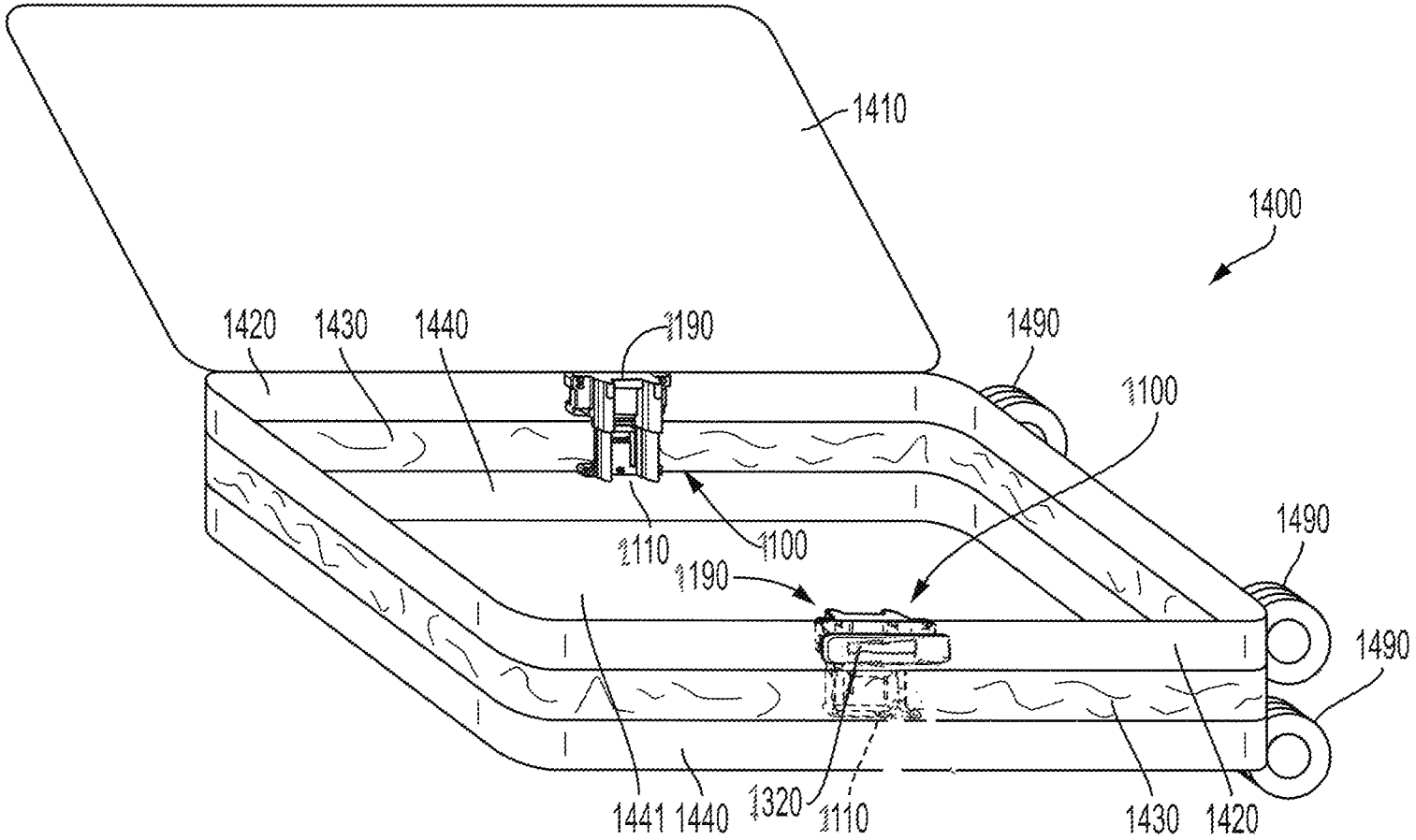
Figure 7C:
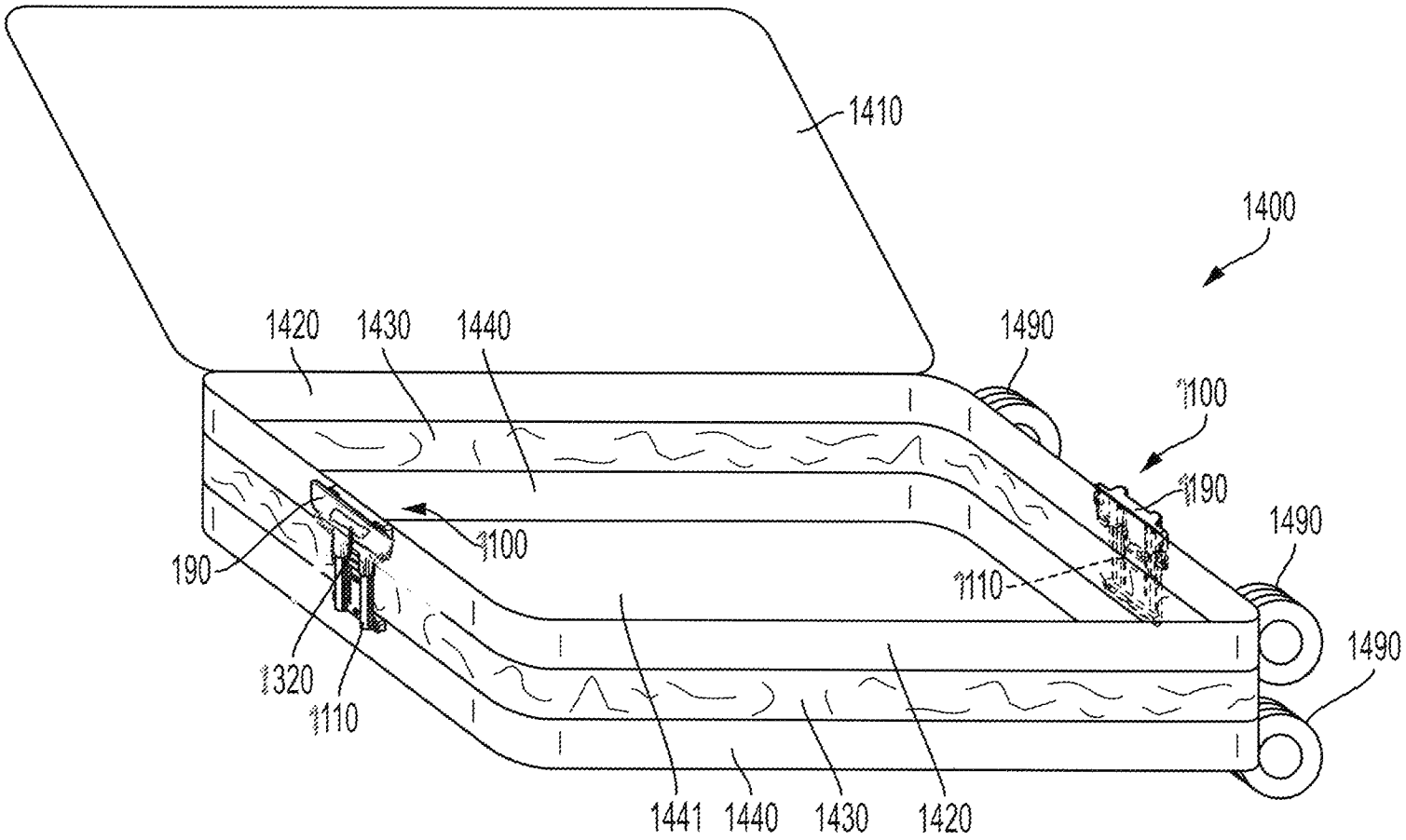
Figure 7D:
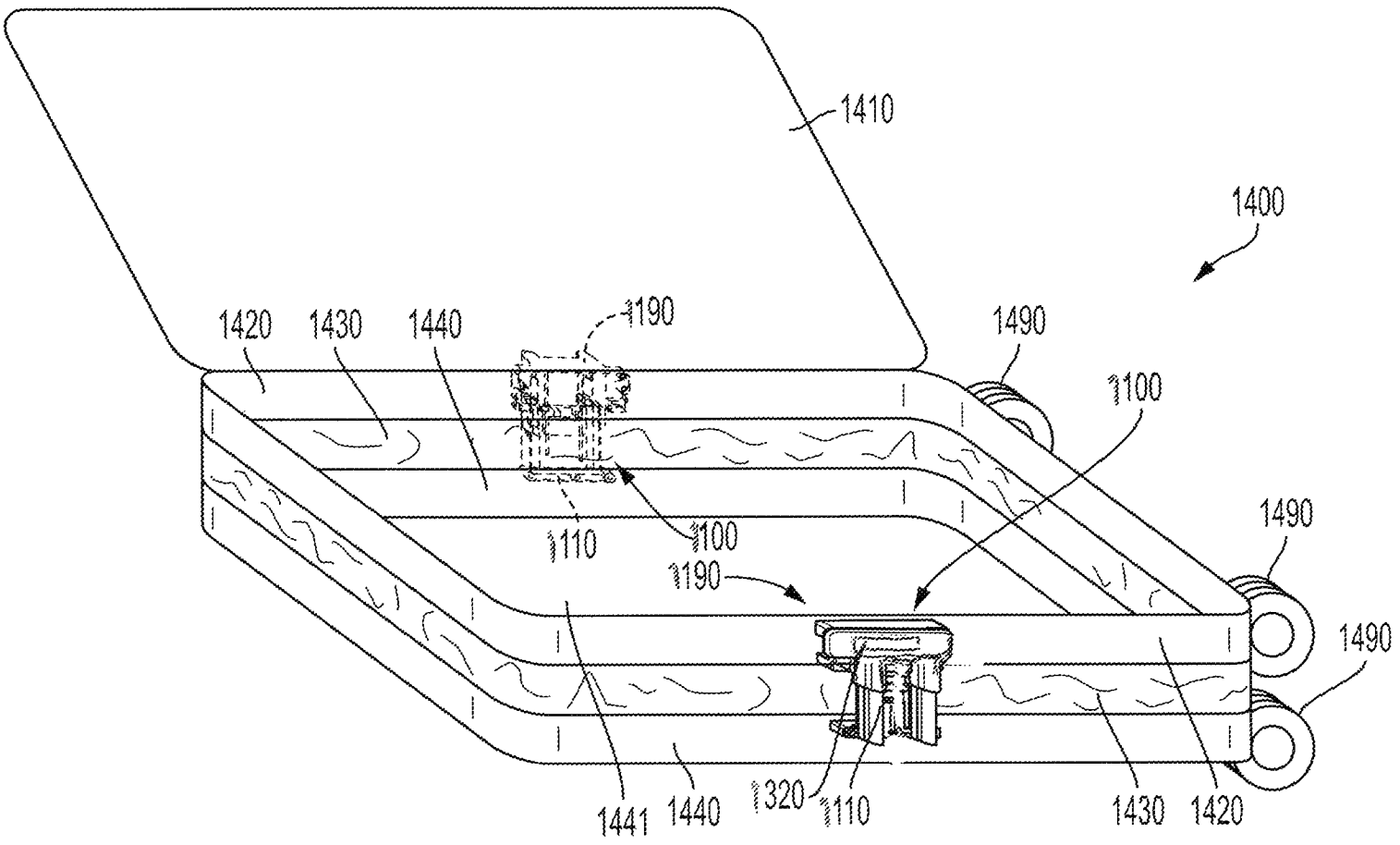

FIG. 7A depicts a practice wherein two compression expansion devices 1100 are employed, with one affixed to an internal side of the wall on which the wheels 1490 are located (the bottom wall of the luggage article is upright, i.e. with the wheels 1490 are on the ground) and a second device 1100 is affixed to the internal side of the opposite wall (the top wall when the luggage article 1400 is upright). FIG. 7B depicts another practice wherein two compression expansion devices 1100 are employed, with one affixed to an internal side of the wall that is vertical to the wall on which the wheels 1490 are located (the vertical side of the luggage article when it is upright and a second device 1100 is affixed to the internal side of the opposite vertical wall. FIG. 7C depicts yet another practice wherein two compression expansion devices 1100 are employed, with one affixed to the outside of the wall on which the wheels 1490 are located (the bottom wall of the luggage article is upright, and a second device 1100 is affixed to the outside of the opposite wall (the top wall when the luggage article 1400 is upright). FIG. 7D depicts still another practice wherein two compression expansion devices 1100 are employed, with one affixed to the outside of the wall that is vertical to the wall on which the wheels 1490 are located (the vertical side of the luggage article when it is upright) and a second device 1100 is affixed to the outside of the opposite vertical wall. When a compression expansion device 1100 is located on an external outer wall, coverings may be employed to protect the device.

In another embodiment of the disclosure, an article of luggage is contemplated embodying the compression-expansion device of the disclosure, e.g. as shown in FIG. 6.

Figure 8:
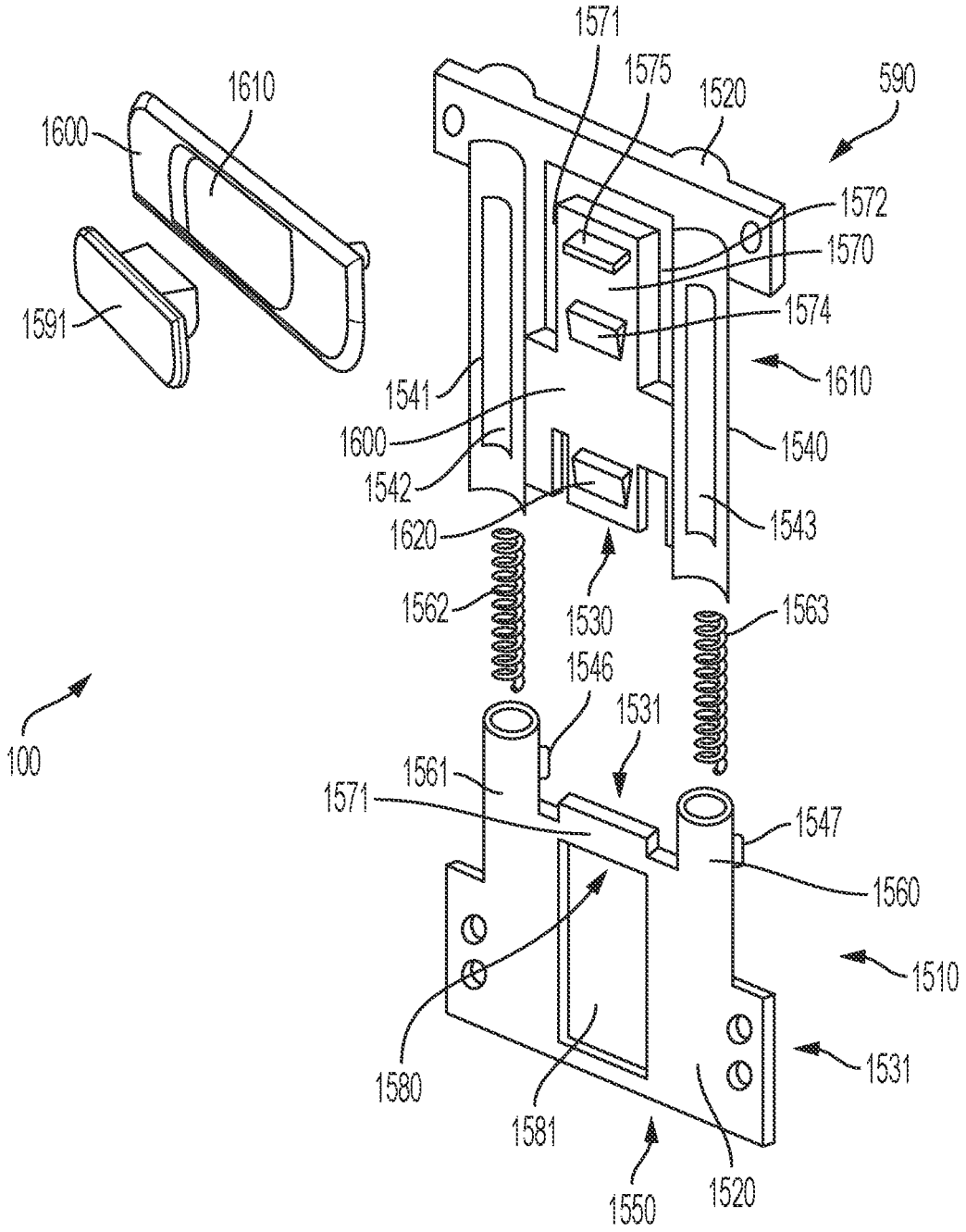
FIG. 8 is a perspective exploded view of another embodiment of a compression and expansion device of the disclosure.
Figure 9B:
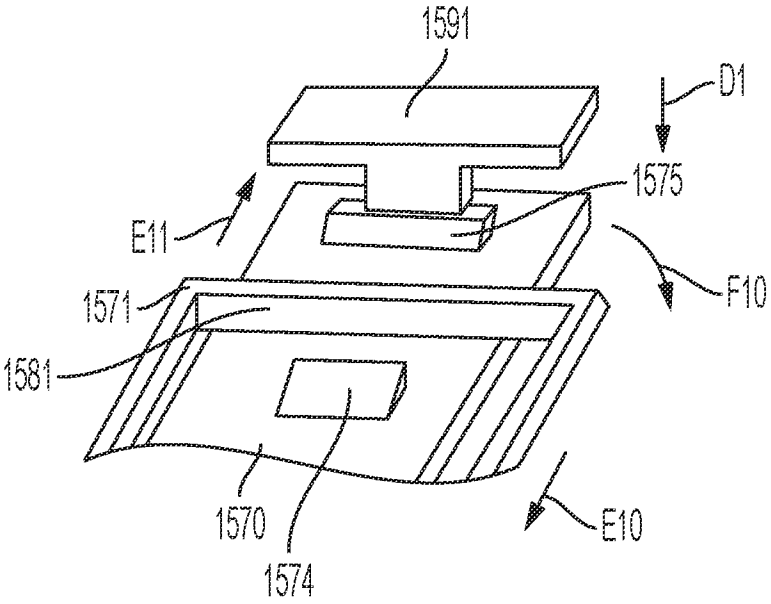
FIGS. 9A and 9B are partial perspective views of views of the embodiment of FIG. 8 showing operation of the flexible portion and button with the compression expansion device in locked (FIG. 9A) and expanded (FIG. 9B) configurations.
Figure 9A:
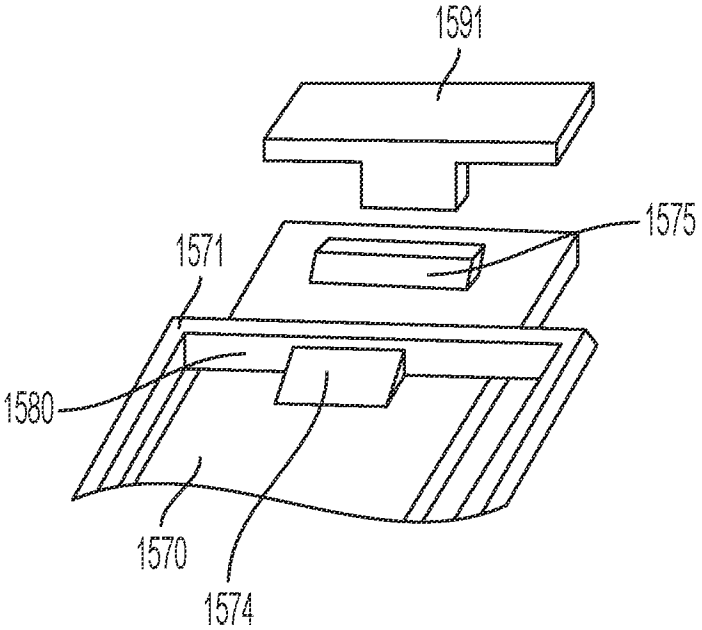

Additional reference to FIGS. 8, 9A, 9B is made whereat is depicted a second embodiment of a compression and expansion device 100 of the disclosure is depicted. Elements in common with the embodiments described hereinabove are further described there and are incorporated herein by reference including discussion of FIGS. 1 to 7 inclusive. Turning to FIGS. 8, 9A, 9B, the embodiment depicted comprises a base section 1510 which comprises a front face 1520, a rear face 1531, a top edge 1531, and a bottom edge 1550. A pair of spaced apart, parallel passageways 1560, 1561 axially disposed on the base section, and a holding surface 1580 disposed between the pair of spaced apart, parallel passageways 1560, 1561. In the non-limiting practice depicted, holding surface 1580 is the underside of arch 1571 which can fully or partially span passageways 1560, 1561. In the practice shown, area 1581 is open; in another practice (not shown), area 1581 is filled and holding surface 1580 can comprise the underside of a ledge. As depicted, expansion body 1590 comprises an inner face 1600, an outer face 1610, an upper edge 1520, and a lower edge 1530. A pair of spaced apart parallel conduit members 1540, 1541 are axially disposed on the expansion body, each of the pair of spaced apart parallel conduit members individually mated in a slidable manner with a respective spaced apart parallel passageway 1560, 1561 of the base section 1510; as shown, the inner face 1600 of the expansion body 1590 is disposed opposite the rear face 1530 of the base section 1510.

Expansion body 1590 comprises a flexible portion 1570 disposed between the pair of spaced apart parallel conduit members 1540, 1541. The flexible portion 1570 comprises at least one protuberance 1574 extending outwardly from inner face 1600, and at least one release protrusion 1575 extending outwardly from the inner face 1600 of the expansion body 1590. In the practice depicted, protuberance 1574 is shown as a ridge; other shapes and sizes of protuberances can be employed and a single or multiple protuberances can be used. In one practice, the release protrusion 1575 is axially spaced from the protuberance 1574 (along the axis generally in the direction of from the upper edge 1520 to the lower edge 1530, including along the same such axis), and in another practice release protrusion 1575 extends outwardly beyond the protuberance 1574. In one practice, as shown, release protrusion 1575 is located proximate the upper edge 520 of expansion body 1590 and is on the same vertical axis as protuberance 1574 which is located beneath release protrusion 1575 distal from the upper edge 1520. In the practice shown, release protrusion 1575 has a generally rectangular cross section when viewed from upper edge 1520; other shapes and sizes of release protrusions can be employed and a single or multiple such release protrusions can be used. In the practice depicted, optional cleat 1620 extends outwardly from the inner face 1600 and is located axially and distal from the protuberance 1574 and proximate the lower edge 1530 and configured to contact the holding surface 1580 sufficient to stop the movement of the base section 1510 away from the expansion body 1590, e.g. the holding surface 1580 will impact cleat 1620 and thereby movement will cease.

In the practice illustrated, a pair of biasing members 1562, 1563, shown as coil springs, are each individually disposed within a respective passageway and its respective conduit member, and each individually urges the expansion body 1590 away from the base section 1510 to an expanded configuration. A button 1591 is disposed opposite from and movable so as to contact release projection 1575. Button 1591 is configured to sufficiently contact the release protrusion 1575 when the button is depressed so as to displace the protuberance 1574 from the holding surface 1580 to a second position when the button 1591 whereby the base section 1510 and expansion body 1590 assume the expanded configuration.

As shown in the non-limiting practice in FIGS. 9A and 9B: FIG. 9A depicts the base section 1510 (only the arch 1571 being depicted) and the expansion body 1590 (only the flexible portion being depicted) in a compressed configuration wherein protuberance 1574 is resting on holding surface

1580, which is the underside of arch 1571); button 1591 is shown positioned away from release projection 1575 (the button is in a non-depressed state). FIG. 9B depicts the release operation: as shown, button 1591 is depressed in the direction of arrow D1, causing it to contact release projection 1575 sufficient to bend (or flex) the flexible portion 1570 in the direction of arrow F10 whereby protuberance 1574 disengages from holding surface 1580 sufficient for the base section and expansion body to assume an expanded configuration, as shown in FIG. 9B with base section (only arch 1571 being depicted) moving in the direction of arrow E10 and/or the expansion body (only the flexible portion 1570) moving in the direction of arrow E11.

In the practice shown, flexible portion 1570 is configured as a leaf spring, the leaf spring configuration constituting flexible portion 1570 is the area defined by and between a pair of slits 1571, 1572 which extend from proximate the upper edged 1520 toward the lower edge 1530, and through the inner 1600 and outer face 1610 of expansion body 1590. In one practice, the button 1591 is housed in a cover plate 1600 which can attached to the upper end of the expansion body, the cover plate having an opening 1610 through which the button is accessed by the user.

In one optional practice, the pair of spaced apart, parallel conduit members 1540, 1541 disposed on the expansion body section 1590 each individually comprise a slot 1542, 1543 disposed along all or part of the length of the respective passageway. The pair of spaced apart parallel passageways 1560, 1561 axially disposed on the base section 510 each individually comprise a stop projection 1546, 1547 configured to extend through a respective slot 1542, 1543 sufficient to contact a respective closed end thereby halting the movement of the expansion body 1590 away from the base section 1510 either at a designated stopping point, or to prevent disassembly of the base section 1510 from the expansion body 1590. In one practice, the pair of spaced apart parallel passageways 1560, 1561 are each individually of generally cylindrical shape, although other shapes suitable for sliding engagement may be employed, and extend outwardly in part from the rear face 1530 of the base section 1510; and the pair of spaced apart parallel conduit members 1540, 1541 are each individually of generally cylindrical shape, although other shapes suitable for sliding engagement may be employed, and extend outwardly in part from the outer face 1610 of the expansion body 1590.

What is claimed is:

1. A compression-expansion device for an article of luggage which comprises:

(a) a base comprising:

a front face, a rear face, a top edge, and a bottom edge, a pair of spaced apart, parallel passageways axially disposed from the top edge of the base to the bottom edge the base, (b) a latch comprising an upper end, a lower end, and an inside face, the latch interposed between the pair of spaced apart passageways with the inside face of the latch disposed opposite the front face of the base, the upper end of the latch extending above the top edge of the base, the upper end comprising a tongue projecting outwardly from the inside face of the latch, and the lower end of the latch pivotably attached to the base, (c) a biasing member connecting the latch to the base and urging the latch toward the front face of the base;

(d) an expansion body comprising:

an inner face, and outer face, an upper edge, a bottom edge, and a pair of spaced apart, parallel conduit members extending from the bottom edge of the expansion body, each of the parallel conduit members individually mated in a slidable manner with a respective passageway of the base, a pair of bias members, each individually disposed within a respective passageway and its respective conduit member, and each individually urging the expansion body away from the base to an expanded configuration, an opening in the expansion body extending between the inner face and outer face and configured to receive the tongue of the latch member from the direction of the inner face, the opening comprising a ridge on which the tongue rests in a first position wherein the expansion body and the base are in a compressed configuration, and (e) a button engaged with the opening of the expansion body from the direction of the outer face, the button moveable to contact the tongue so as to sufficiently displace the tongue off the ridge to a second position whereby the expansion body and the base assume the expanded configuration urged by the pair of bias members.

2. The device of claim 1 wherein the pair of spaced apart, parallel passageways each comprise a generally tubular channel extending outwardly from the front face of the base.

3. The device of claim 1 wherein the latch is pivotably attached to the base about a pivot axis that is perpendicular to the pair of spaced apart, parallel passageways.

4. The device of claim 2 wherein the latch is pivotably attached to the tubular channels proximate the bottom edge of the base.

5. The device of claim 1 wherein the biasing member is a coil spring.

6. The device of claim 1 wherein the pair of spaced apart, parallel conduit members are each generally cylindrical in shape.

7. The device of claim 6 wherein the pair of spaced apart, parallel passageways each comprise a generally tubular channel extending outwardly from the front face of the base, and each generally cylindrical conduit member is slidably disposed within its respective tubular channel.

8. The device of claim 7 wherein each generally tubular channel comprises a slot disposed along all or part of the length of the respective tubular channel, each slot having a first closed end proximate the top edge of the base; and wherein each generally cylindrical conduit member comprises a projection proximate its distal end and configured to extend into its respective slot and contact the first closed end of the slot to stop the movement of the expansion body away from the base.

9. The device of claim 1 wherein the top section comprises at least one latch stopping member extending from the bottom edge of the top section and interposed between the pair of spaced apart, parallel conduit members, the at least one latch stopping member configured to provide contact with the tongue of the latch in the second position so as to prevent the tongue from extending over the top edge of the base when the expansion body and the base are in the expanded configuration.

10. The device of claim 9 wherein the distal end of the at least one latch stopping member extends at least partly over the front face of the base.

11. The device of claim 1 wherein the top section further comprises a button housing disposed against the outside face of the top section, the button housing comprising an aperture therethrough aligned with the opening in the top section, and configured to secure the button so that the button is moveable within the aperture and the opening.

12. The device of claim 1 wherein the pair of bias members each comprise a coil spring.

13. An article of luggage comprising:

a main luggage body having a bottom surface and a cavity formed to receive articles for packing;

an expansion portion having a perimeter defining a cavity;

a foldable gusset joining the luggage main body to the expansion portion; and at least on compression-expansion device disposed on a wall of the article of luggage, the compression-expansion device comprising:

(i) a base affixed to one of the luggage main body or the expansion portion, the base comprising:

a front face, a rear face, a top edge, and a bottom edge, a pair of spaced apart, parallel passageways axially disposed from the top edge of the base to the bottom edge the base, a latch comprising an upper end, a lower end, and an inside face, the latch interposed between the pair of spaced apart passageways with the inside face of the latch disposed opposite the front face of the base, the upper end of the latch extending above the top edge of the base, the upper end comprising a tongue projecting outwardly from the inside face of the latch, and the lower end of the latch pivotably attached to the base, a biasing member connecting the latch to the base and urging the latch toward the front face of the base;

(ii) an expansion body affixed to the other of the main luggage body or the expansion portion, the expansion body comprising:

an inner face, and outer face, an upper edge, a bottom edge, and a pair of spaced apart, parallel conduit members extending from the bottom edge of the expansion body, each of the parallel conduit members individually mated in a slidable manner with a respective passageway of the base, a pair of bias members, each individually disposed within a respective passageway and its respective conduit member, and each individually urging the expansion body away from the base to an expanded configuration, an opening in the expansion body extending between the inner face and outer face and configured to receive the tongue of the latch member from the direction of the inner face, the opening comprising a ridge on which the tongue rests in a first position wherein the expansion body and the base are in a compressed configuration, and a button engaged with the opening of the expansion body from the direction of the outer face, the button moveable to contact the tongue so as to sufficiently displace the tongue off the ridge to a second position whereby the expansion body and the base assume the expanded configuration urged by the pair of bias members.

14. The article of luggage of claim 13 wherein the pair of spaced apart, parallel passageways each comprise a generally tubular channel extending outwardly from the front face of the base.

15. The article of luggage of claim 13 wherein the latch is pivotably attached to the base about a pivot axis that is perpendicular to the pair of spaced apart, parallel passageways.

16. The article of luggage of claim 14 wherein the latch is pivotably attached to the tubular channels proximate the bottom edge of the base.

17. The article of luggage of claim 13 wherein the biasing member is a coil spring.

18. The article of luggage of claim 13 wherein the pair of spaced apart, parallel conduit members are each generally cylindrical in shape.

19. The article of luggage of claim 18 wherein the pair of spaced apart, parallel passageways each comprise a generally tubular channel extending outwardly from the front face of the base, and each generally cylindrical conduit member is slidably disposed within its respective tubular channel.

20. The article of luggage of claim 19 wherein each generally tubular channel comprises a slot disposed along all or part of the length of the respective tubular channel, each slot having a first closed end proximate the top edge of the base; and wherein each generally cylindrical conduit member comprises a projection proximate its distal end and configured to extend into its respective slot and contact the first closed end of the slot to stop the movement of the expansion body away from the base.

21. The article of luggage of claim 13 wherein the top section comprises at least one latch stopping member extending from the bottom edge of the top section and interposed between the pair of spaced apart, parallel conduit members, the at least one latch stopping member configured to provide contact with the tongue of the latch in the second position so as to prevent the tongue from extending over the top edge of the base when the expansion body and the base are in the expanded configuration.

22. The article of luggage of claim 21 wherein the distal end of the at least one latch stopping member extends at least partly over the front face of the base.

23. The article of luggage of claim 13 wherein the pair of bias members each comprise a coil spring.

24. The article of luggage of claim 13 wherein the top section further comprises a button housing disposed against the outside face of the top section, the button housing comprising an aperture therethrough aligned with the opening in the top section, and configured to secure the button so that the button is moveable within the aperture and the opening.

* * * * *